US009202664B2

(12) United States Patent
Wassom et al.

(10) Patent No.: US 9,202,664 B2
(45) Date of Patent: Dec. 1, 2015

(54) FINNED ANODE

(71) Applicant: VARIAN MEDICAL SYSTEMS, INC., Palo Alto, CA (US)

(72) Inventors: Jeffrey Steven Wassom, West Jordan, UT (US); Dennis H. Runnoe, Salt Lake City, UT (US); Robert Clark Treseder, North Salt Lake, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 189 days.

(21) Appl. No.: 13/651,282

(22) Filed: Oct. 12, 2012

(65) Prior Publication Data

US 2014/0105366 A1 Apr. 17, 2014

(51) Int. Cl.
*H01J 35/10* (2006.01)

(52) U.S. Cl.
CPC ..... *H01J 35/106* (2013.01); *H01J 2235/125* (2013.01); *H01J 2235/1237* (2013.01); *H01J 2235/1283* (2013.01)

(58) Field of Classification Search
USPC ..... 378/129, 127, 130
See application file for complete search history.

(56) References Cited

U.S. PATENT DOCUMENTS

| | | | | |
|---|---|---|---|---|
| H0000312 | H * | 7/1987 | Parker | 378/127 |
| 6,115,454 | A * | 9/2000 | Andrews et al. | 378/140 |
| 6,456,692 | B1 * | 9/2002 | Smith | 378/129 |
| 6,603,834 | B1 * | 8/2003 | Lu et al. | 378/141 |
| 8,249,219 | B2 * | 8/2012 | Parker | 378/141 |
| 2007/0297570 | A1 | 12/2007 | Kerpershoek et al. | |
| 2010/0322384 | A1 | 12/2010 | Parker | |

FOREIGN PATENT DOCUMENTS

| | | |
|---|---|---|
| EP | 0184623 A2 | 6/1986 |
| JP | 3229310 B2 | 11/2001 |

OTHER PUBLICATIONS

International Search Report and Written Opinion mailed Jan. 13, 2014 in related International PCT Application No. PCT/US2013/064331.

* cited by examiner

*Primary Examiner* — Phillip A Johnston
*Assistant Examiner* — Hsien Tsai
(74) *Attorney, Agent, or Firm* — Maschoff Brennan

(57) ABSTRACT

Finned anode. In one example embodiment, an anode suitable for use in an x-ray tube includes a hub, a front side, and a target surface disposed on the front side. The hub is configured to attach to a bearing assembly and the front side substantially faces the bearing assembly. The anode further includes a rear side substantially opposite the front side, as well as two or more annular anode fins extending from the rear side. The annular anode fins are positioned radially outward from the hub to an outer periphery of the rear side.

20 Claims, 7 Drawing Sheets

FINNED ANODE

BACKGROUND

X-ray devices are extremely valuable tools that are used in a wide variety of applications such as industrial and medical. For example, such equipment is commonly employed in areas such as medical diagnostic examination, therapeutic radiology, semiconductor fabrication, and materials analysis.

Regardless of the applications in which they are employed, most x-ray devices operate in a similar fashion. X-rays are produced in such devices when electrons are emitted from a cathode, accelerated, and then impinged upon a material of a particular composition located on an anode. This process typically takes place within an x-ray tube located in the x-ray device. The x-ray tube directs x-rays at an intended subject in order to produce an x-ray image.

One challenge encountered with the operation of x-ray tubes relates to the substantial amount of heat produced during x-ray imaging. To produce x-rays, the x-ray tube receives a large amount of electrical energy. However, only a small fraction of the electrical energy is converted into x-rays, while the majority of the electrical energy is converted to heat. If excessive heat is produced in the x-ray tube, temperatures may rise above critical values. In some instances, when temperatures rise above critical values, various portions of the x-ray tube may be subject to thermally-induced deforming stresses. As a result, the useful life of some parts of the x-ray tube may be shortened. For example, relatively high temperatures may shorten the effective life of an anode or of bearing lubrication. Therefore, operation of the x-ray tube may be limited, in part, by the heat dissipation capacity of the x-ray tube.

An additional challenge encountered with the operation of x-ray tubes relates to the optimum positioning of the subject with respect to the x-ray tube. X-rays emitted from x-ray tubes may experience a "heel effect." The heel effect occurs due to the geometry of the anode. Generally, the heel effect results in an x-ray beam having a lower intensity toward the anode end of the x-ray tube and a higher intensity toward the cathode end of the x-ray tube. An optimum position of the subject may thus be located toward the cathode end of the x-ray tube. However, the size and shape of the cathode and the anode may make optimum positioning difficult, if not impossible, in some instances. For example, difficulties may arise in the use of x-ray tubes for mammography. When performing a mammography, optimally positioning a patient's breast to be x-rayed may be hampered by the remainder of the patient's torso. In particular, the ability to position a patient's breast between an x-ray tube and an x-ray detector may be affected by the size of the breast, the size of the patient's torso, and the size and configuration of the x-ray tube and the x-ray device including the x-ray tube.

The subject matter claimed herein is not limited to embodiments that solve any disadvantages or that operate only in environments such as those described above. Rather, this background is only provided to illustrate example technology areas where some embodiments described herein may be practiced.

SUMMARY

Briefly summarized, embodiments presented herein are directed to a finned anode suitable for use in an x-ray tube. In example embodiments, a finned anode having a target track on the same side as a bearing assembly is configured with anode fins on an opposite side so as to efficiently transfer heat away from the target track in a manner that minimizes excessive heating of other tube components, particularly the bearing assembly. This provides a number of advantages, including an increase in the effective life of the finned anode and bearing lubrication and a reduction of heat-related damage to the bearing assembly, as well as other x-ray tube components. Furthermore, the x-ray tube may be operated at an increased continuous power without being limited by the amount of heat dissipation capacity available to the x-ray tube. Disclosed embodiments may improve the results of x-ray imaging while allowing placement of the x-ray beam to remain relatively near a wall of an x-ray device.

In one example embodiment, a finned anode suitable for use in an x-ray tube includes a hub, a front side, and a target surface disposed on the front side. The hub is configured to attach to a bearing assembly and the front side substantially faces the bearing assembly. The anode further includes a rear side substantially opposite the front side, as well as two or more annular anode fins extending from the rear side. The annular anode fins are positioned radially outward from the hub to an outer periphery of the rear side.

In another example embodiment, an anode assembly suitable for use in an x-ray tube includes a finned anode and a thermal plate. The finned anode is configured to be rotatably supported by a bearing assembly and includes a front side that substantially faces the bearing assembly with a target surface for receiving an electron stream. The finned anode further includes a rear side substantially opposite the front side and two or more annular anode fins extending from the rear side. The thermal plate includes two or more annular plate fins configured to be interleaved with the annular anode fins.

In yet another example embodiment, an x-ray tube includes an evacuated enclosure, a cathode positioned within the evacuated enclosure, a bearing assembly, a rotatable finned anode positioned within the evacuated enclosure, and a thermal plate. The rotatable finned anode includes a hub attached to the bearing assembly and a front side that substantially faces the bearing assembly with a target surface for receiving an electron stream. The rotatable anode further includes a rear side substantially opposite the front side and two or more annular anode fins extending from the rear side. The thermal plate includes an inner side positioned within the evacuated enclosure and two or more annular plate fins extending from the inner side and interleaved with the annular anode fins. The thermal plate further includes an outer side substantially opposite the inner side. The outer side is configured to be proximate a liquid coolant.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments that are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION

X-ray devices designed to optimally position a subject to minimize heel effects, such as x-ray devices designed for mammography applications, are currently designed to include as little intervening structure as practical between the target surface and an adjacent wall of the x-ray device housing. By including as little intervening structure as practical between the target surface and an adjacent wall of the x-ray device housing, the target surface may, in turn, be located as close to the adjacent wall as practical. As a result, the subject may be optimally positioned in order to counter the heel effect of the x-ray beam. However, such a design may limit the continuous intensity of the x-ray beam. For example, the x-ray beam intensity may be limited by the amount of heat that the x-ray device can effectively dissipate.

In general, the following example embodiments provide an example anode assembly that is configured to efficiently dissipate excessive heat from a finned anode in a manner that minimizes excessive heat from reaching components of the anode assembly and other x-ray tube components. For example, in disclosed embodiments, excessive heat is dissipated from the region of a bearing assembly that rotatably supports the finned anode. This dissipating of excessive heat may provide a number of advantages, including extending the operational life of the attached bearing assembly. Embodiments may include the ability to dissipate heat from the finned anode, at least in part, through fins included between the target surface and the adjacent wall of the x-ray tube. Although the ability to counter the heel effect of the x-ray beam through placement of the subject may be somewhat reduced, continuous x-ray intensity may nevertheless be increased such that the overall quality of the x-ray imaging may be significantly improved.

Reference will now be made to the figures wherein like structures will be provided with like reference designations. The drawings are diagrammatic and schematic representations of example embodiments, and are not limiting of the present invention, nor are they necessarily drawn to scale.

I. Example X-Ray Device and X-Ray Tube

Figure 1A:
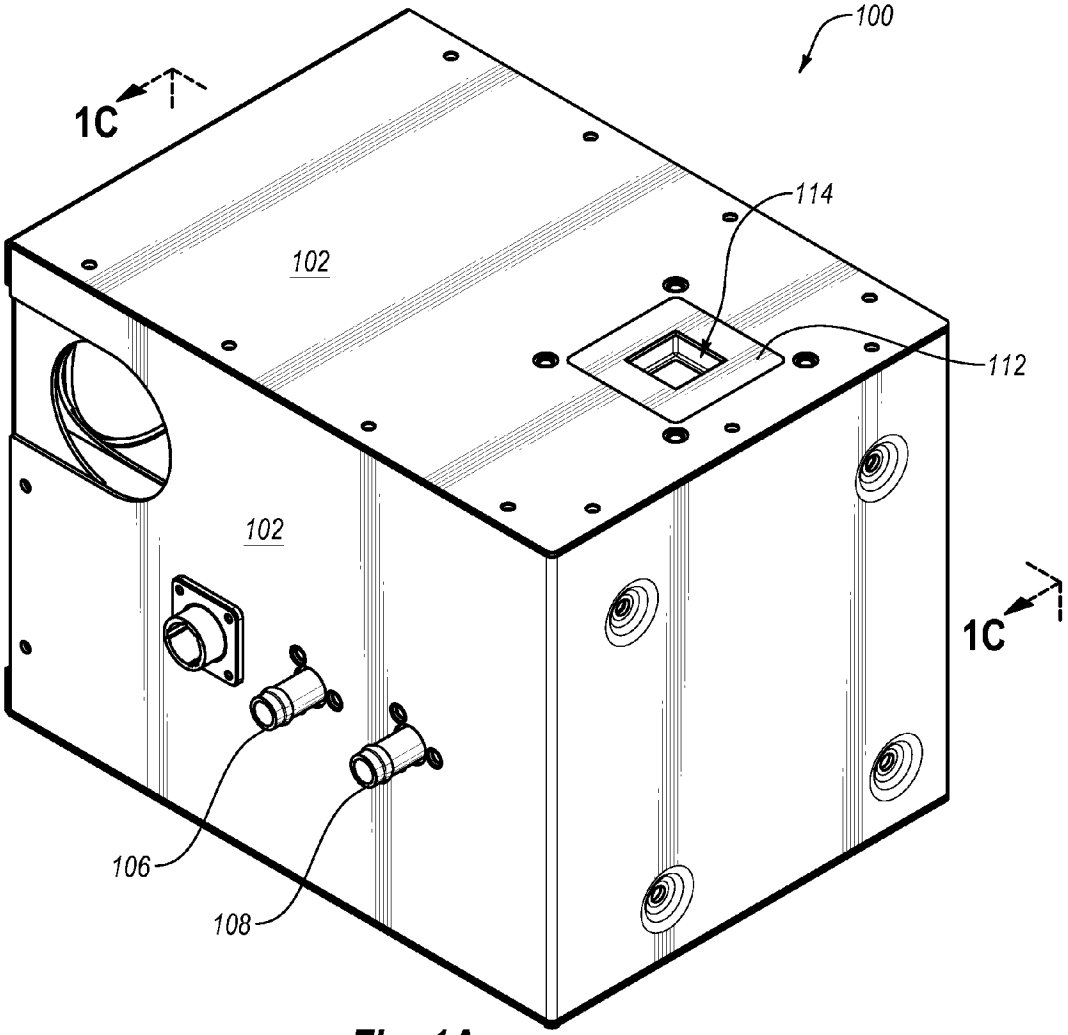
FIG. 1A is a rear perspective view of an example x-ray device including an x-ray tube disposed within a housing.
Figure 1B:
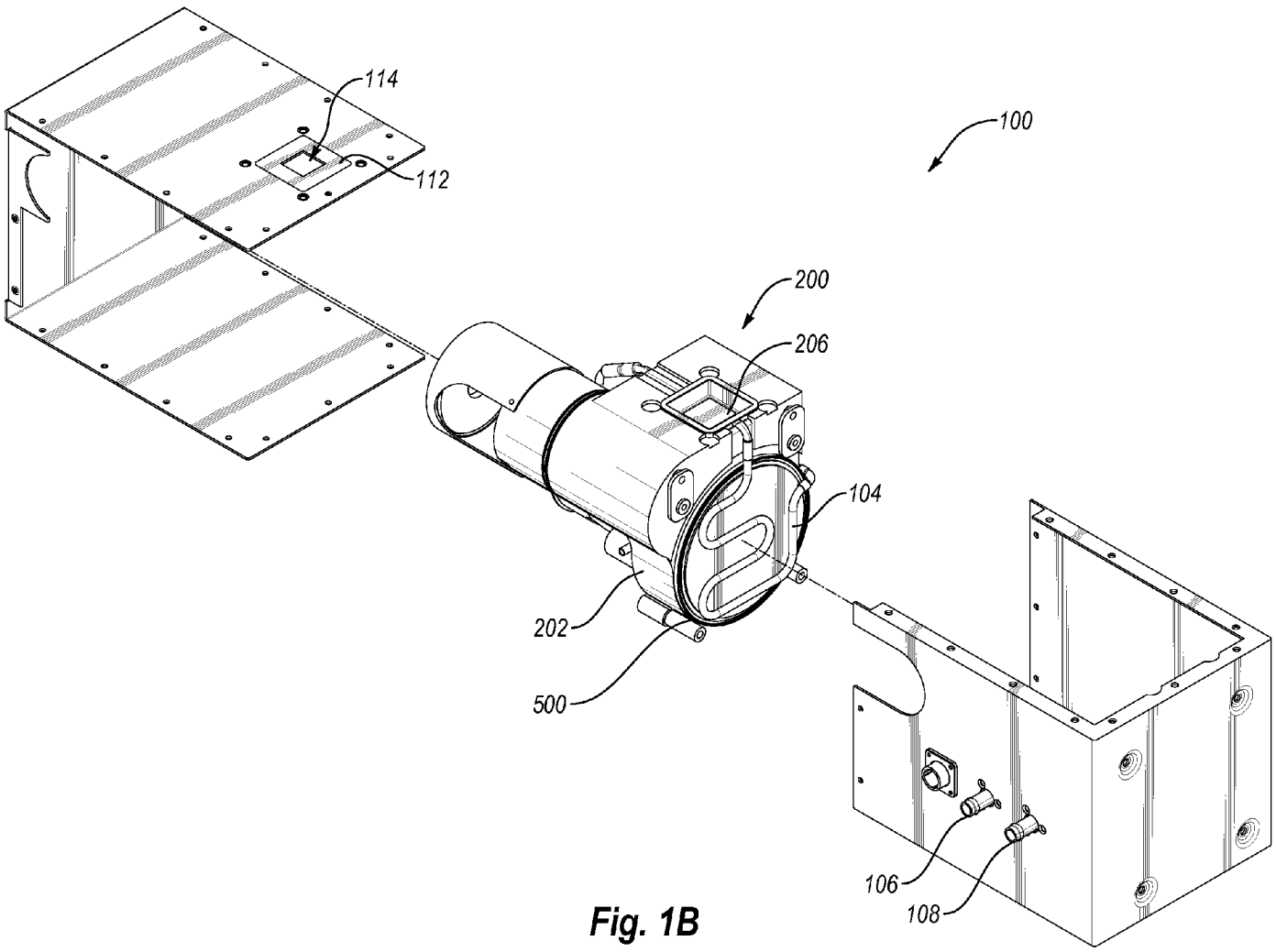
FIG. 1B is an exploded rear perspective view of the example x-ray device of FIG. 1A.
Figure 1C:
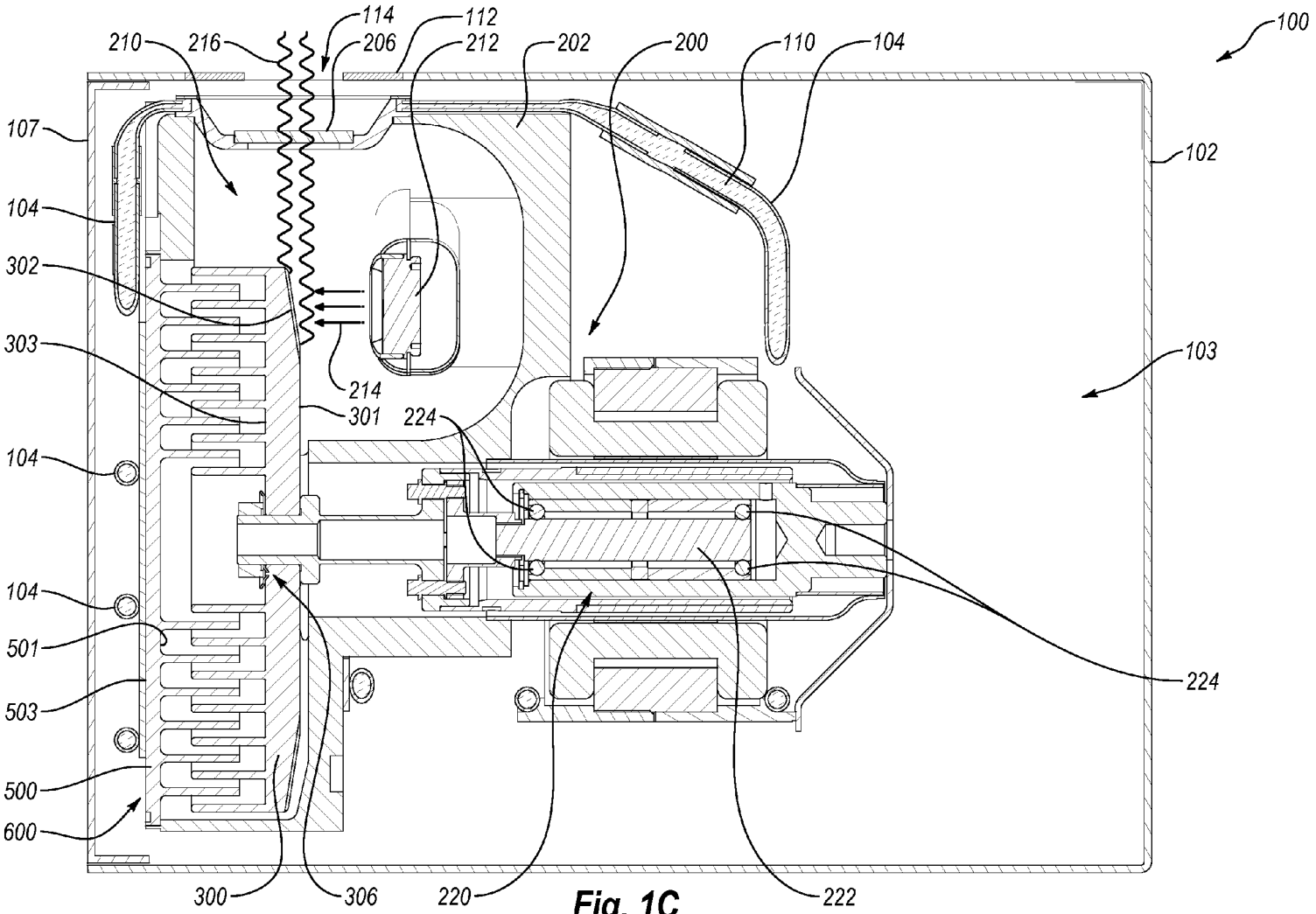
FIG. 1C is a cross-sectional side view of the example x-ray device of FIG. 1A.

With reference first to FIGS. 1A-1C, one example of an environment in which embodiments of the present invention might be utilized is depicted.

FIG. 1A is a rear perspective view of an example x-ray device 100 including an x-ray tube 200 (see FIGS. 1B and 1C) disposed within a housing 102. The housing 102 generally includes a beam diaphragm 112 including an aperture 114, a liquid coolant input port 106, and a liquid coolant output port 108.

FIG. 1B is an exploded rear perspective view of the example x-ray device 100 of FIG. 1A. The x-ray tube 200 includes a "can" 202 having an x-ray tube window 206 formed therein. When the x-ray tube 200 is mounted inside the housing 102, the x-ray tube window 206 aligns with the beam diaphragm 112, thereby allowing x-rays to be emitted through the x-ray tube window 206 and through the aperture 114 towards a subject of interest, such as a body part of a medical patient. X-rays that strike the beam diaphragm 112 rather than passing through the aperture 114 may be absorbed by the beam diaphragm 112. The beam diaphragm 112 may be made of lead or another material suitable for absorbing x-rays. The x-ray tube 200 also includes a thermal plate 500, which will be described in additional detail with reference to FIGS. 2A-2D.

FIG. 1C is a cross-sectional side view of the example x-ray device 100 of FIG. 1A. The housing 102 forms a compartment 103. The compartment may contain air. The air may naturally circulate around the x-ray tube 200 to aid cooling of the x-ray tube 200 and to provide electrical isolation between the x-ray tube 200 and the housing 102. In some embodiments, the compartment 103 may instead be configured to contain a liquid coolant. For example, the compartment 103 may be configured to contain dielectric oil, which may exhibit acceptable thermal and electrical insulating properties.

Positioned within the x-ray tube 200 is an evacuated enclosure 210 at least partially defined by the can 202 and the x-ray tube window 206, a bearing assembly 220, and the thermal plate 500. The evacuated enclosure 210 is evacuated to create a vacuum. Positioned within the evacuated enclosure 210 are a cathode 212 and a rotatable finned anode 300. The finned anode 300 includes a front side 301 and a rear side 303. The front side 301 is spaced apart from and oppositely positioned to the cathode 212. The front side includes a target surface 302. The target surface 302 faces both the cathode 212 and the bearing assembly 220. This configuration of the bearing assembly 220 reduces the distance between the target surface 302 and the nearest wall 107 of the housing 102. The close proximity of the target surface 302 and the nearest wall 107 of the housing 102 potentially allows a subject to be positioned such that the effect caused by the heel effect is reduced.

The rear side 303 is positioned substantially opposite the front side 301, as generally shown in FIG. 1C. The rear side 303 is further spaced apart from and oppositely positioned to the thermal plate 500.

The finned anode 300 is at least partially composed of a thermally-conductive material. In some embodiments, the finned anode 300 is at least partially composed of tungsten or a molybdenum alloy. The finned anode 300 and the cathode 212 are connected within an electrical circuit that allows for the application of a high-voltage potential between the finned anode 300 and the cathode 212. In some example embodiments, the finned anode 300 and the thermal plate 500 are maintained at a similar voltage potential to prevent electrical arcing between the finned anode 300 and the thermal plate 500. In some embodiments, the finned anode 300 and the thermal plate 500 are electrically grounded.

The cathode 212 includes a filament that is connected to an appropriate power source, and during operation, an electrical current is passed through the filament to cause an electron stream, designated at 214, to be emitted from the cathode 212 by thermionic emission. The application of a high-voltage differential between the finned anode 300 and the cathode 212 causes the electron stream 214 to accelerate from the filament toward a target surface 302 positioned on the front side 301 of the finned anode 300. The target surface 302 is typically composed of tungsten or a similar material having a high atomic ("high Z") number. As the electrons of the electron stream 214 accelerate, they gain a substantial amount of kinetic energy, and upon striking the target material on the target surface 302, some of this kinetic energy is converted into electromagnetic waves of very high frequency, i.e., x-rays 216.

The target surface 302 is oriented such that the x-rays 216 may pass through the x-ray tube window 206. The x-ray tube window 206 is made of an x-ray transmissive material, to permit the x-rays 216 emitted from the target surface 302 to pass through the x-ray tube window 206 and the aperture 114 of the beam diaphragm 112. Once through the aperture 114, the x-rays 216 may be detected by a detector array (not shown) after being partially attenuated by an intended subject (not shown) in order to produce an x-ray image (not shown). The x-ray tube window 206 enables x-rays 216 to exit the x-ray tube 200 while maintaining a vacuum within the evacuated enclosure 210.

The bearing assembly 220 of the x-ray tube 200 may be positioned at least partially inside the evacuated enclosure 210. The bearing assembly 220 includes a spindle 222 and bearings 224. The spindle 222 is attached to a hub 306 of the finned anode 300. The spindle 222 may act as a rotor and may be rotated by a stator. The bearings 224 support the spindle 222 during rotation, thus allowing the finned anode 300 to rotate.

As the electron stream 214 strikes the target surface 302, a significant amount of the kinetic energy of the electron stream 214 is transferred to the target surface 302 as heat. The finned anode 300 may be able to withstand relatively high temperatures. However, the temperatures that the bearing assembly 220 can withstand may be lower than the temperatures that the finned anode 300 can withstand. Accordingly, the x-ray tube 200 is specifically designed to dissipate heat generated at the target surface 302 such that only an acceptable amount of heat is transferred to the bearing assembly 220.

To promote heat dissipation, the x-ray tube 200 includes a coolant passageway 104 configured to direct liquid coolant 110 to specific areas of the x-ray tube 200. In some embodiments, the liquid coolant 110 is dielectric oil. The coolant passageway 104 may be positioned so as to circulate the liquid coolant 110 in regions experiencing higher operating temperatures, such as in the region of the x-ray tube window 206 and the region of the thermal plate 500, which is disposed adjacent to the finned anode 300. In particular, the coolant passageway 104 may promote heat transfer from the thermal plate 500, which may, in turn, promote heat transfer from the finned anode 300.

In the embodiment shown, the liquid coolant 110 is circulated into the coolant passageway 104 through the liquid coolant input port 106 (see FIGS. 1A and 1B) via a pump (not shown). During operation, heat is radiated and/or conducted to the external surfaces of the x-ray tube 200 and is then transferred to the liquid coolant 110 by way of the coolant passageway 104. The heated liquid coolant 110 is circulated out of the coolant passageway 104 via output port 108 (see FIGS. 1A and 1B). The heated liquid coolant 110 may be directed to a heat exchanger (not shown) to cool the liquid coolant 110. The cooled liquid coolant 110 may then be recirculated through the coolant passageway 104.

II. Example Anode Assembly

Figure 2A:
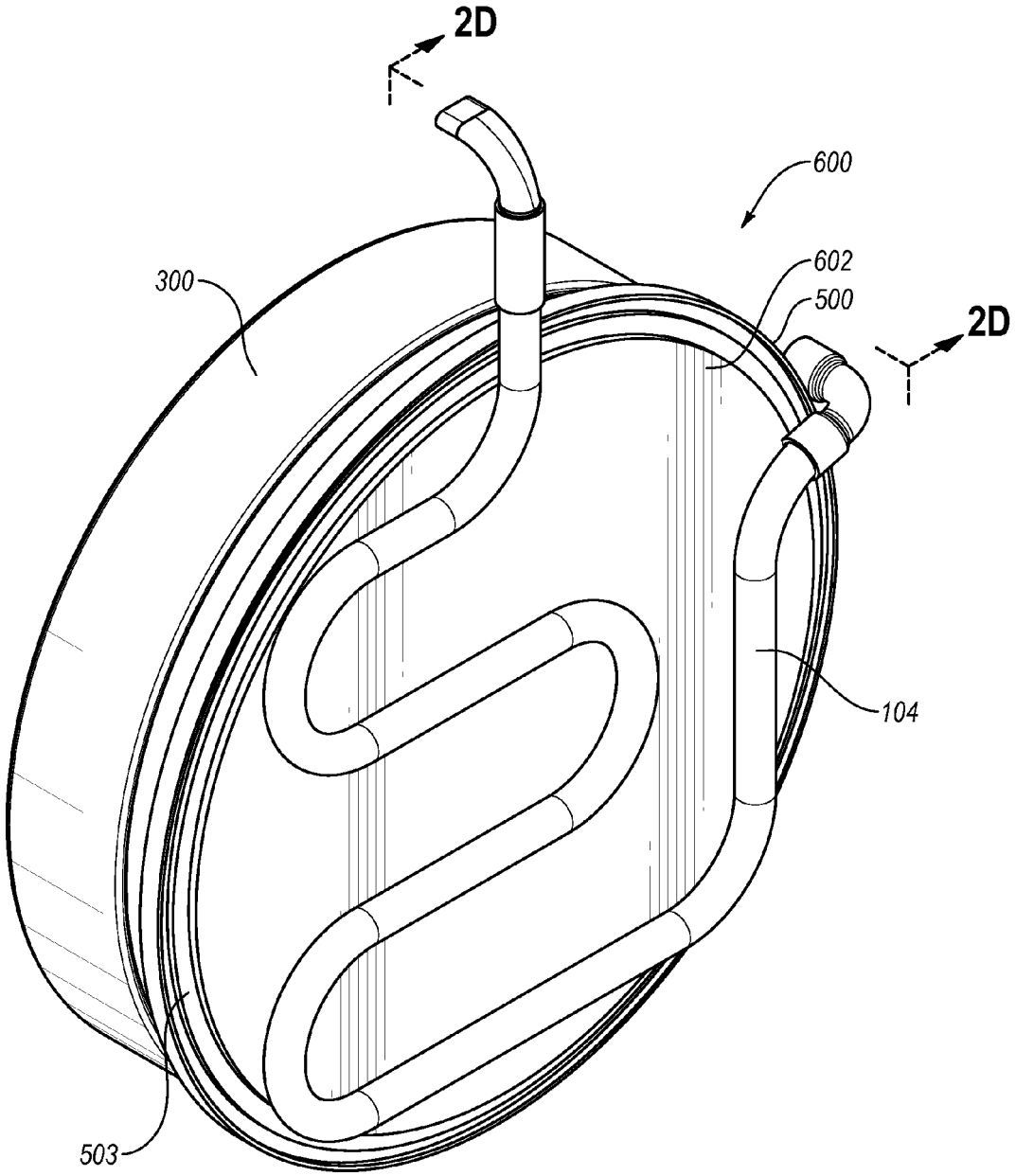
FIG. 2A is a rear perspective view of an example x-ray tube anode assembly of the example x-ray device of FIGS. 1A-1C.

With continued reference to the example x-ray tube 200 disclosed in FIGS. 1B and 1C, FIGS. 2A-2D particularly disclose an example anode assembly 600. FIG. 2A is a rear perspective view of the example x-ray tube anode assembly 600 of the example x-ray device 100 of FIGS. 1A-1C. The example anode assembly 600 may generally include the finned anode 300, the thermal plate 500, and at least a portion of the coolant passageway 104.

Figure 2B:
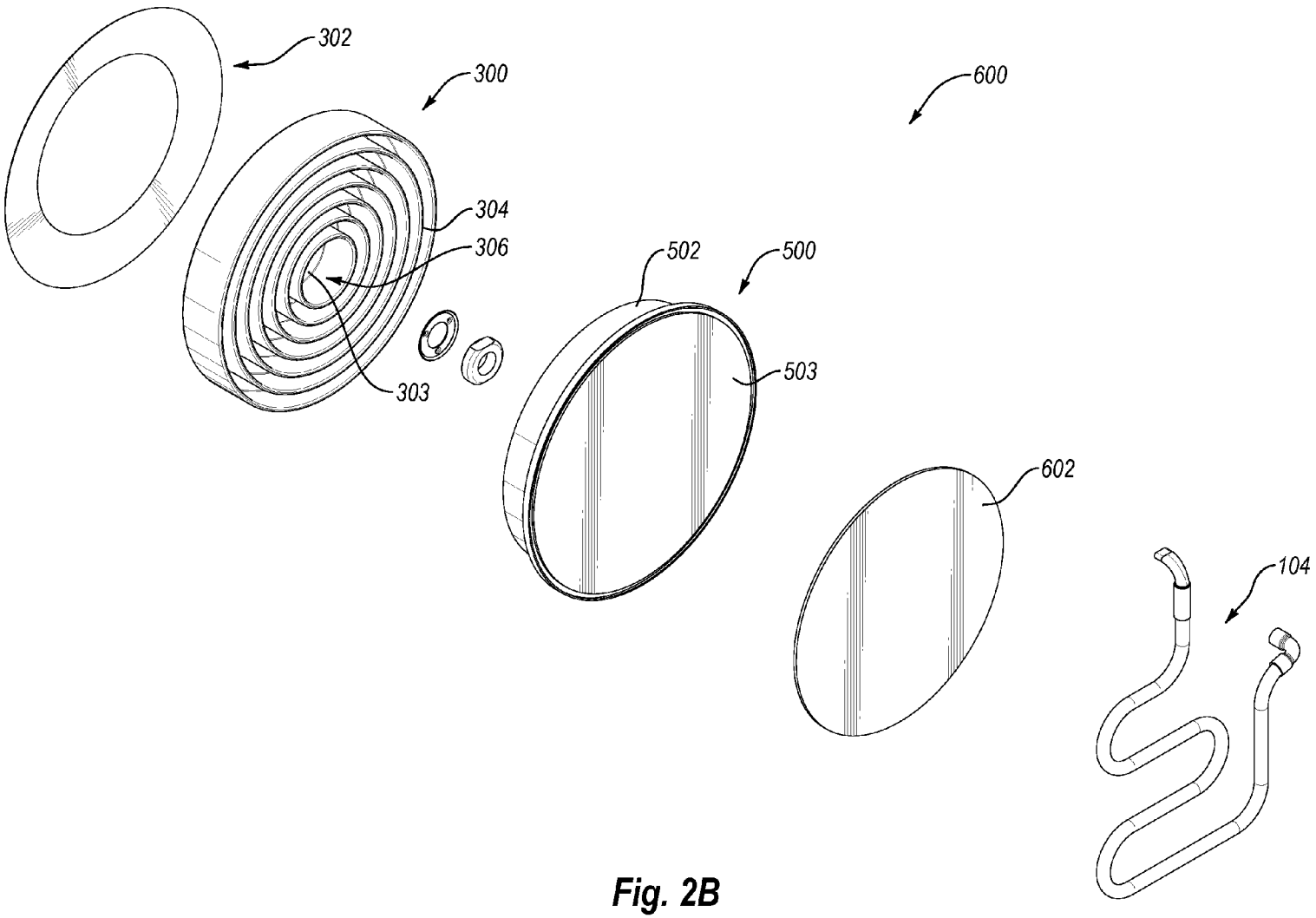
FIG. 2B is an exploded rear perspective view of the example x-ray tube anode assembly of FIG. 2A.
Figure 2C:
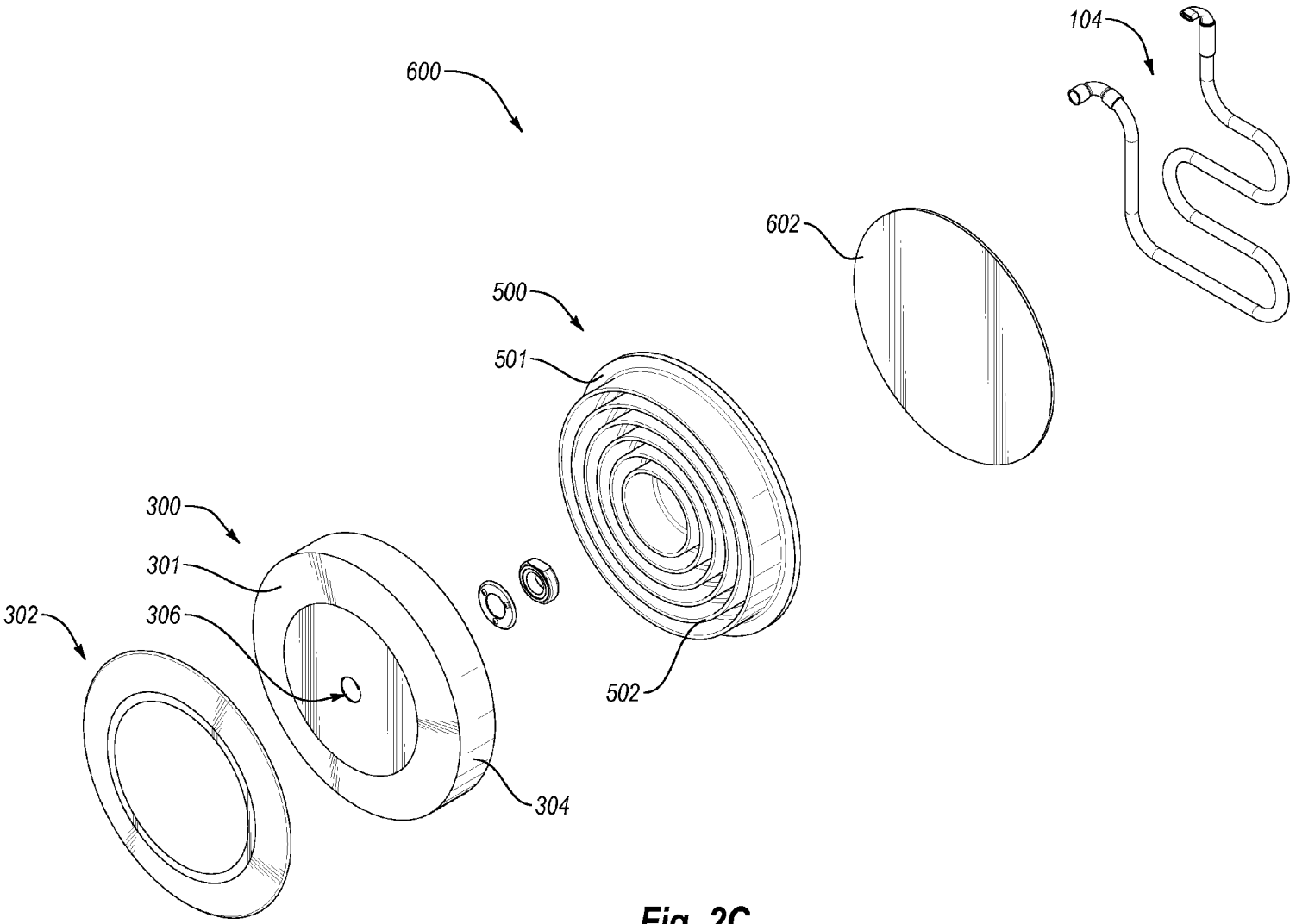
FIG. 2C is an exploded front perspective view of the example x-ray tube anode assembly of FIG. 2A.

FIGS. 2B and 2C are exploded rear and front perspective views, respectively, of the example anode assembly 600 of FIG. 2A. As disclosed in FIGS. 2B and 2C, the example finned anode 300 generally includes a target surface 302, a hub 306, and anode fins 304. The hub 306 is positioned at the center of the finned anode 300 and is attached to the bearing assembly 220 (shown in FIG. 1C). The target surface 302 is disposed on the front side 301 of the finned anode 300 facing both the cathode 212 and the bearing assembly 220 (shown in FIG. 1C). The anode fins 304 extend from the rear side 303 of the finned anode 300. In some example embodiments, the anode fins 304 are substantially annular and are positioned radially outward from the hub 306 to an outer periphery of the finned anode 300 as shown in FIG. 2B. Although shown as unbroken annular anode fins 304, smaller fins may be employed and arranged in an annular pattern positioned radially outward from the hub 306.

The finned anode 300 may be formed from a variety of materials. For example, the target surface 302 may be formed from tungsten or rhenium, or a combination thereof. The anode fins 304 may be formed from graphite, molybdenum, titanium, or zirconium, or some combination thereof. The finned anode 300 may be formed using a sintering and machining process, for example.

The example thermal plate 500 generally includes plate fins 502 positioned on an inner side 501 of the thermal plate 500. The plate fins 502 may be located inside the evacuated enclosure 210 (shown in FIG. 1C). An outer side 503 of the thermal plate 500 is located opposite the inner side 501, and may be positioned outside the evacuated enclosure 210 (shown in FIG. 1C) and proximate the liquid coolant 110 (shown in FIG. 1C). The coolant passageway 104 may circulate the liquid coolant 110 (shown in FIG. 1C) near the thermal plate 500. Optionally, a thermally-conductive interface 602, which may be formed from copper for example, may be located between the coolant passageway 104 and the outer side 503 of the thermal plate 500.

Figure 2D:
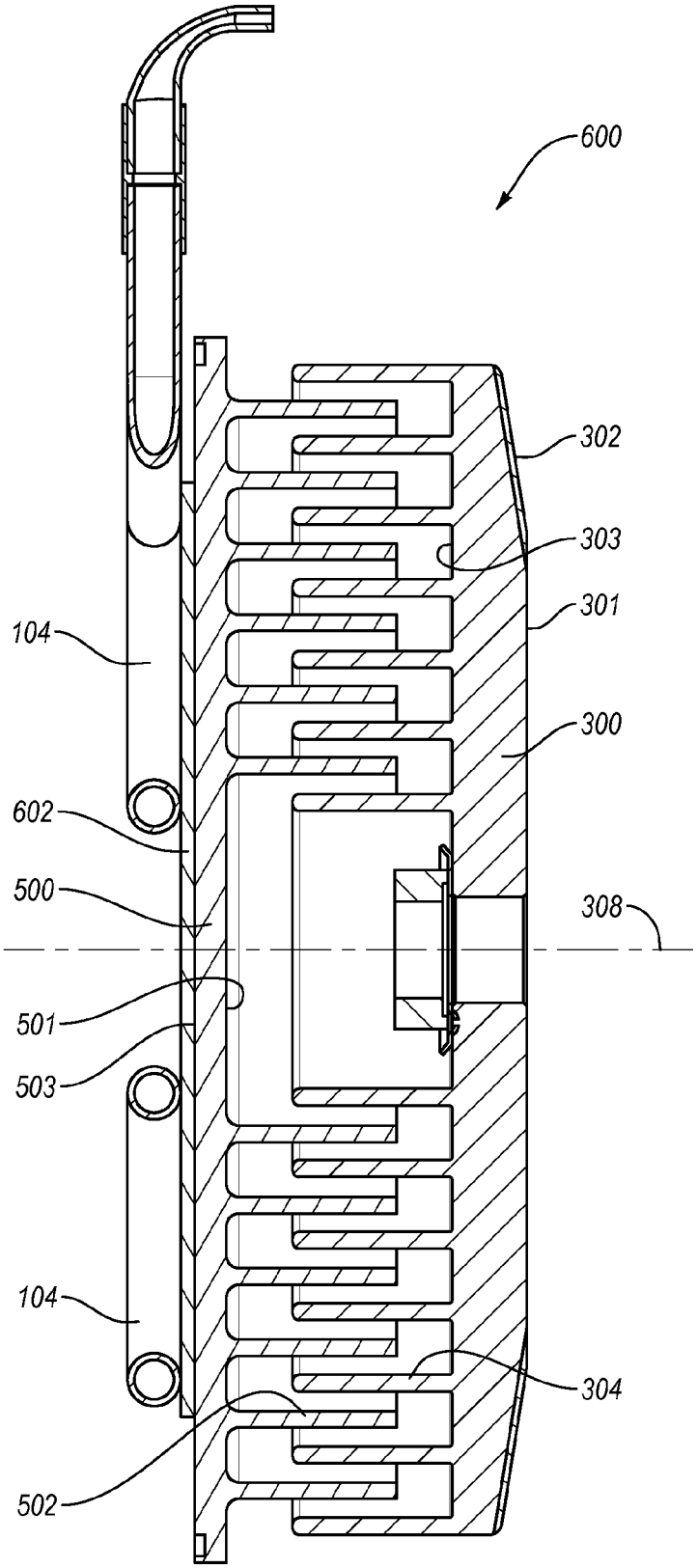
FIG. 2D is a cross-sectional side view of the example x-ray tube anode assembly of FIG. 2A.

FIG. 2D is a cross-sectional view of the example anode assembly 600 of FIG. 2A. As disclosed in FIG. 2D, the example anode fins 304 may have a substantially uniform thickness and may be separated by a substantially uniform spacing. Similarly, the example plate fins 502 may have a substantially uniform thickness and may be separated by a substantially uniform spacing. However, in some embodiments, the anode fins 304 and/or the plate fins 502 may have a non-uniform thickness or may be separated by a non-uniform spacing. In embodiments where the finned anode 300 and the thermal plate 500 are maintained at a similar voltage potential, such as ground, the spacing between the anode fins 304 and the plate fins 502 may be brought relatively close together with a relatively low risk of electrical arcing. As a result, maintaining a similar voltage potential between the finned anode 300 and the thermal plate 500 may allow for increased heat transfer between the finned anode 300 and the thermal plate 500. For example, more anode fins and plate fins may be included, respectively, on the finned anode 300 and the thermal plate 500 in embodiments that maintain a similar voltage potential between the finned anode 300 and the thermal plate 500. By increasing the number of the anode fins and the plate fins, the overall surface area of the finned anode 300 and thermal plate 500 may be increased, and the overall spacing between the anode fins 304 and the plate fins 502 may be decreased. In turn, the radiative heat transfer between the finned anode 300 and the thermal plate 500 may be increased.

The anode fins 304 interleave with the plate fins 502. Preferably, the anode fins 304 and the plate fins 502 are generally concentric about a common axis 308. In some embodiments, the anode fins 304 and the plate fins 502 may substantially be the only intervening structures between the finned anode 300 and the thermal plate 500. The positioning of the anode fins 304 and the plate fins 502 facilitates the radiant transfer of heat from the finned anode 300 to the thermal plate 500. In particular, the heat generated at the target surface 302 of the finned anode 300 may generally transfer to the anode fins 304 by way of conduction. Then, at least a portion of the heat may transfer from the anode fins 304 to the plate fins 502 via radiation. Heat from the plate fins 502 may then transfer to the coolant passageway 104 by way of conduction and then to the liquid coolant 110 (shown in FIG. 1C) inside the coolant passageway 104 by way of convection. Heat may further be transferred by way of convection from the thermal plate 500 and/or the thermally-conductive interface 602 to the air located within the compartment 103 (shown in FIG. 1C).

In some embodiments, at least a portion of a surface of one or more of the anode fins 304 may include means for increasing a thermal emittance of the surface. One example of a structural implementation of a means for increasing a thermal emittance is a coating of an emissive material that increases the thermal emittance of the coated surfaces. For example, the anode fins 304 may be coated, at least in part, with a titanium chromium oxide. The emissive coating may be applied using a flame spraying process. The emissive coating may increase the efficiency of the anode fins 304 in radiating heat away from the finned anode 300 and toward the thermal plate 500.

It is noted that a variety of means may be employed to perform the functions disclosed herein concerning the increasing of a thermal emittance. Thus, the configuration of the coating of an emissive material comprises but one example structural implementation of means for increasing of a thermal emittance. Accordingly, it should be understood that such structural implementation is disclosed herein solely by way of example and should not be construed as limiting the scope of the present invention in any way. Rather, any other structure or combination of structures effective in implementing the functionality disclosed herein may likewise be employed.

It is understood that the number of anode fins 304 and plate fins 502 can differ from the number shown in the drawings. Accordingly, the number of each of these components in the drawings is but one example and is not limiting of the current invention.

The example embodiments disclosed herein may be embodied in other specific forms. The example embodiments disclosed herein are therefore to be considered in all respects only as illustrative and not restrictive.

What is claimed is:

1. A finned anode suitable for use in an x-ray tube, the anode comprising:
- a hub configured to attach to a bearing assembly including one or more bearings;
- a front side substantially facing each bearing of the bearing assembly;
- a target surface disposed on the front side;
- a rear side substantially opposite the front side; and
- two or more annular anode fins extending from the rear side, the annular anode fins being positioned radially outward from the hub to an outer periphery of the rear side.

2. The finned anode as recited in claim 1, wherein at least a portion of a surface of one or more of the annular anode fins comprises means for increasing a thermal emittance of the surface.

3. The finned anode as recited in claim 2, wherein the means for increasing the thermal emittance comprises a coating of titanium chromium oxide.

4. The finned anode as recited in claim 1, wherein the annular anode fins comprise a graphite material.

5. The finned anode as recited in claim 1, wherein the annular anode fins have a substantially uniform thickness and are separated by a substantially uniform spacing.

6. An anode assembly suitable for use in an x-ray tube, the anode assembly comprising:
- a finned anode configured to be rotatably supported by a bearing assembly including one or more bearings, the finned anode including:
  - a front side including a target surface for receiving an electron stream, the target surface substantially facing each bearing of the bearing assembly,
  - a rear side substantially opposite the front side, and
  - two or more annular anode fins extending from the rear side; and
- a thermal plate including two or more annular plate fins configured to be interleaved with the annular anode fins.

7. The anode assembly as recited in claim 6, wherein the thermal plate is configured to be proximate a liquid coolant.

8. The anode assembly as recited in claim 6, further comprising a coolant passageway proximate the thermal plate, the coolant passageway configured to circulate a liquid coolant.

9. The anode assembly as recited in claim 6, wherein the annular anode fins comprise a graphite material.

10. The anode assembly as recited in claim 6, wherein at least a portion of a surface of one or more of the annular anode fins comprises means for increasing a thermal emittance of the surface.

11. The anode assembly as recited in claim 10, wherein the means for increasing the thermal emittance comprises a coating of titanium chromium oxide.

12. The anode assembly as recited in claim 6, wherein the annular anode fins have a substantially uniform thickness and are separated by a substantially uniform spacing.

13. An x-ray tube comprising:
- an evacuated enclosure;
- a cathode positioned within the evacuated enclosure and configured to produce an electron stream;
- a bearing assembly including one or more bearings;
- a rotatable finned anode positioned within the evacuated enclosure, the rotatable finned anode including:
  - a hub attached to the bearing assembly,
  - a front side including a target surface for receiving the electron stream, the front side substantially facing each bearing of the bearing assembly,
  - a rear side substantially opposite the front side, and
  - two or more annular anode fins extending from the rear side; and
- a thermal plate including:
  - an inner side positioned within the evacuated enclosure,
  - two or more annular plate fins extending from the inner side and interleaved with the annular anode fins, and
  - an outer side substantially opposite the inner side, the outer side positioned outside the evacuated enclosure and configured to be proximate a liquid coolant.

14. The x-ray tube as recited in claim 13, the x-ray tube further comprising a coolant passageway positioned proximate the outer side and outside the evacuated enclosure, the coolant passageway configured to circulate a liquid coolant.

15. The x-ray tube as recited in claim 13, wherein the annular anode fins comprise a graphite material.

16. The x-ray tube as recited in claim 13, wherein the annular anode fins have a uniform thickness and are separated by a uniform spacing.

17. The x-ray tube as recited in claim 13, wherein the rotatable finned anode is electrically grounded.

18. The x-ray tube as recited in claim 13, wherein intervening structures between the rear side and the inner side consist essentially of the annular anode fins and the annular plate fins.

19. The x-ray tube as recited in claim 13, wherein at least a portion of a surface of one or more of the annular anode fins comprises means for increasing a thermal emittance of the surface.

20. The x-ray tube as recited in claim 19, wherein the means for increasing the thermal emittance comprises a coating of titanium chromium oxide.

* * * * *